US011840439B1

(12) United States Patent
Pamplin

(10) Patent No.: US 11,840,439 B1
(45) Date of Patent: Dec. 12, 2023

(54) REFILL STATION FOR REFILLABLE CARBONATION CONTAINER

(71) Applicant: BlendJet Inc., Benicia, CA (US)

(72) Inventor: Ryan Michael Pamplin, San Juan, PR (US)

(73) Assignee: BlendJet Inc., Benicia, CA (US)

( * ) Notice: Subject to any disclaimer, the term of this patent is extended or adjusted under 35 U.S.C. 154(b) by 0 days.

(21) Appl. No.: 17/730,914

(22) Filed: Apr. 27, 2022

(51) Int. Cl.
*B67D 1/08* (2006.01)
*B67D 1/00* (2006.01)
*B67C 3/22* (2006.01)

(52) U.S. Cl.
CPC ..... *B67D 1/0057* (2013.01); *B67C 3/22* (2013.01); *B67D 1/0069* (2013.01)

(58) Field of Classification Search
CPC ..... B67D 1/0057; B67D 1/0069; B67C 3/22
See application file for complete search history.

(56) References Cited

U.S. PATENT DOCUMENTS 4,610,282 A * 9/1986 Brooks ..... B01F 23/2361 426/477
5,270,069 A * 12/1993 Plester ..... B67D 1/1405 426/124
5,870,944 A * 2/1999 Vander Zalm ..... B01F 23/2361 261/DIG. 7
6,216,913 B1 * 4/2001 Bilskie ..... B67D 1/1247 222/400.7
6,669,051 B1 12/2003 Phallen
7,832,142 B1 11/2010 Olson
8,985,395 B2 * 3/2015 Tansey ..... G06Q 30/0269 222/146.6
9,687,796 B2 * 6/2017 Hoare ..... B01F 35/2112
10,512,358 B1 * 12/2019 Perrelli ..... A45F 3/18
10,863,852 B1 * 12/2020 Lyons ..... B01F 35/2112
2003/0173376 A1 9/2003 Bilskie
2006/0113323 A1 6/2006 Jones
2008/0217363 A1 9/2008 Vitantonio
2013/0062366 A1 3/2013 Tansey
2014/0079856 A1 * 3/2014 Hatherell ..... B67D 1/0406 426/477
2014/0175125 A1 6/2014 Breault
2015/0353335 A1 * 12/2015 Breault ..... B67D 1/0021 222/129.1
2017/0088410 A1 3/2017 Wing
2018/0085763 A1 3/2018 Leckner
2019/0330045 A1 10/2019 Breault

* cited by examiner

*Primary Examiner* — Nicolas A Arnett
(74) *Attorney, Agent, or Firm* — ESPLIN & ASSOCIATES, PC

(57) ABSTRACT

A refill station for refillable carbonation containers is disclosed. Exemplary implementations may include a refill station housing, a refill tank, a control interface, a conduit, a controllable refill valve, and/or other components. The refill tank of the refill station holds a pressurized liquid, such as $CO_2$. The refill station housing holds a carbonation container, such as a bottle, which includes a container tank. A user can control filling or refilling the container tank from the refill tank.

19 Claims, 5 Drawing Sheets

REFILL STATION FOR REFILLABLE CARBONATION CONTAINER

FIELD OF THE DISCLOSURE

The present disclosure relates to a refill station for refillable carbonation containers, and to refilling, using the refill station, the pressurized liquid in refillable carbonation containers, such as $CO_2$.

BACKGROUND

Carbonated liquids are common and known, including but not limited to carbonated water and other drinks. Different mechanisms are known to carbonate a liquid, including but not limited to consumer appliances that can carbonate drinking bottles.

SUMMARY

One aspect of the present disclosure relates to a refill station for refillable carbonation containers. The refill station may include a refill station housing, a refill tank, a control interface, a conduit, a controllable refill valve, and/or other components. A refillable carbonation container may be configured to hold and carbonate liquids. The refill tank of the refill station holds a pressurized liquid, such as $CO_2$. The refill station housing holds the carbonation container, such as a bottle, which includes a container tank. A user can control refilling the container tank from the refill tank. As used herein, both fluids and gases, including $CO_2$, are referred to as liquids. The refillable carbonation container may be portable due to its size. A user can take the refillable carbonation container anywhere to create and enjoy carbonated beverages.

Another aspect of the present disclosure is a method of refilling a refillable carbonation container that includes a container tank having a first volume. The method may include holding, by a refill station housing included in a refill station, all or part of the refillable carbonation container. The method may include holding, by a refill tank included in the refill station, a pressurized liquid. The refill tank has a second volume. The second volume of the refill tank holds an amount of the pressurized liquid that is sufficient to support at least three separate and distinct instances of refilling the container tank of the refillable carbonation container, such that the user can control refilling at least three times the container tank by using the amount of the pressurized liquid held in the refill tank. The method may include receiving, through a control interface included in the refill station, user input from a user to initiate a refill of the container tank included in the refillable carbonation container. The method may include coupling, by a conduit included in the refill station, the refill tank to the container tank of the refillable carbonation. The method may include controlling transfer, by a controllable refill valve included in the refill station, of the pressurized liquid from the refill tank to the container tank. Operation of the controllable refill valve is based at least in part on the user input received through the control interface.

As used herein, any association (or relation, or reflection, or indication, or correspondency) involving tanks, containers, dispensers, outlets, conduits, valves, and/or another entity or object that interacts with any part of the refillable carbonation container and/or plays a part in the operation of the refillable carbonation container, may be a one-to-one association, a one-to-many association, a many-to-one association, and/or a many-to-many association or "N"-to-"M" association (note that "N" and "M" may be different numbers greater than 1).

As used herein, the term "effectuate" (and derivatives thereof) may include active and/or passive causation of any effect. As used herein, the term "determine" (and derivatives thereof) may include measure, calculate, compute, estimate, approximate, generate, and/or otherwise derive, and/or any combination thereof.

These and other features, and characteristics of the present technology, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

DETAILED DESCRIPTION

Figure 1A:
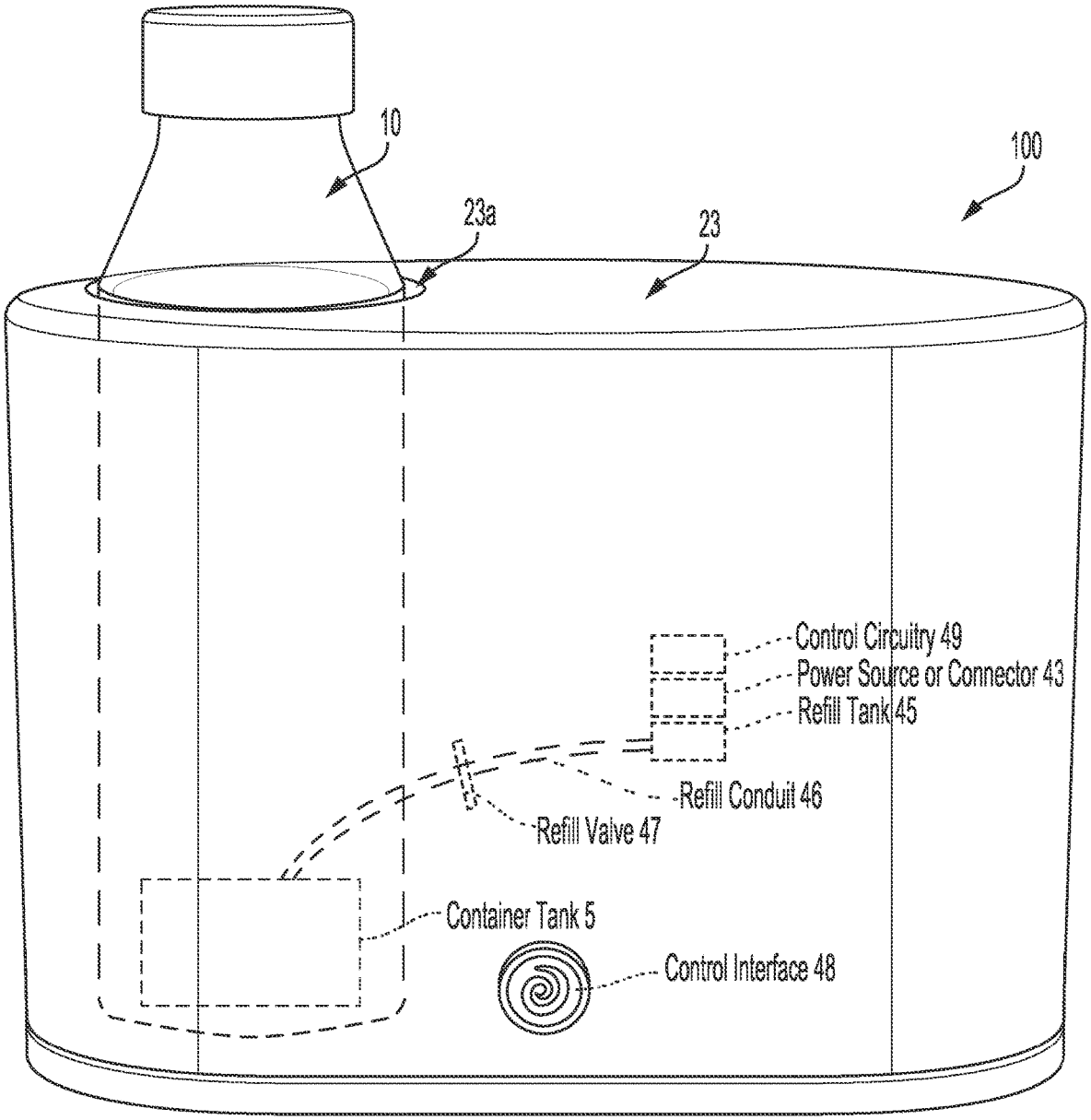
FIG. 1A shows a front view of a refill station and a refillable carbonation container, in accordance with one or more implementations.

FIG. 1A shows a refill station 100 and a refillable carbonation container 10 (also referred to as container 10), in accordance with one or more implementations. Refill station 100 may be configured to fill or refill container 10 with pressurized liquid, such as $CO_2$. Container 10 may be configured to hold and carbonate (potable) liquid, such as water, using pressurized liquid. Refill station 100 may include one or more of a refill station housing 23, a refill tank 45 (depicted in FIG. 1A as a dotted rectangle to indicate this component may be embedded within refill station housing 23, and not readily visible from the outside), a control interface 48, a refill conduit 46 (depicted in FIG. 1A as a dotted rectangle to indicate this component may be embedded within refill station housing 23, and not readily visible from the outside), a (controllable) refill valve 47 (depicted in FIG. 1A as a dotted rectangle to indicate this component may be embedded within refill station housing 23, and not readily visible from the outside), control circuitry 49 (depicted in FIG. 1A as a dotted rectangle to indicate this component may be embedded within refill station housing 23, and not readily visible from the outside), power source or connector 43 (depicted in FIG. 1A as a dotted rectangle to indicate this component may be embedded within refill station housing 23, and not readily visible from the outside), and/or other components. As depicted in FIG. 1A, refill station 100 may be configured to hold all or part of container 10, such that at least some part of container 10 is obscured from view when refill station 100 holds and/or otherwise contains all or part of container 10. In some implementations, refill station housing 23 may include an opening 23*a* such that container 10 can be inserted into refill station 100 and/or refill station housing 23 through opening 23*a*. As depicted in FIG. 1A, opening 23*a* may be deposed at the top side of refill station 100 and/or refill station housing 23. In some implementations, refill station housing 23 may be configured such that manually inserting container 10 can cause container 10 to snap or click into place in a manner that supports the subsequent filling or refilling of container tank 5 from refill tank 45.

Figure 1B:
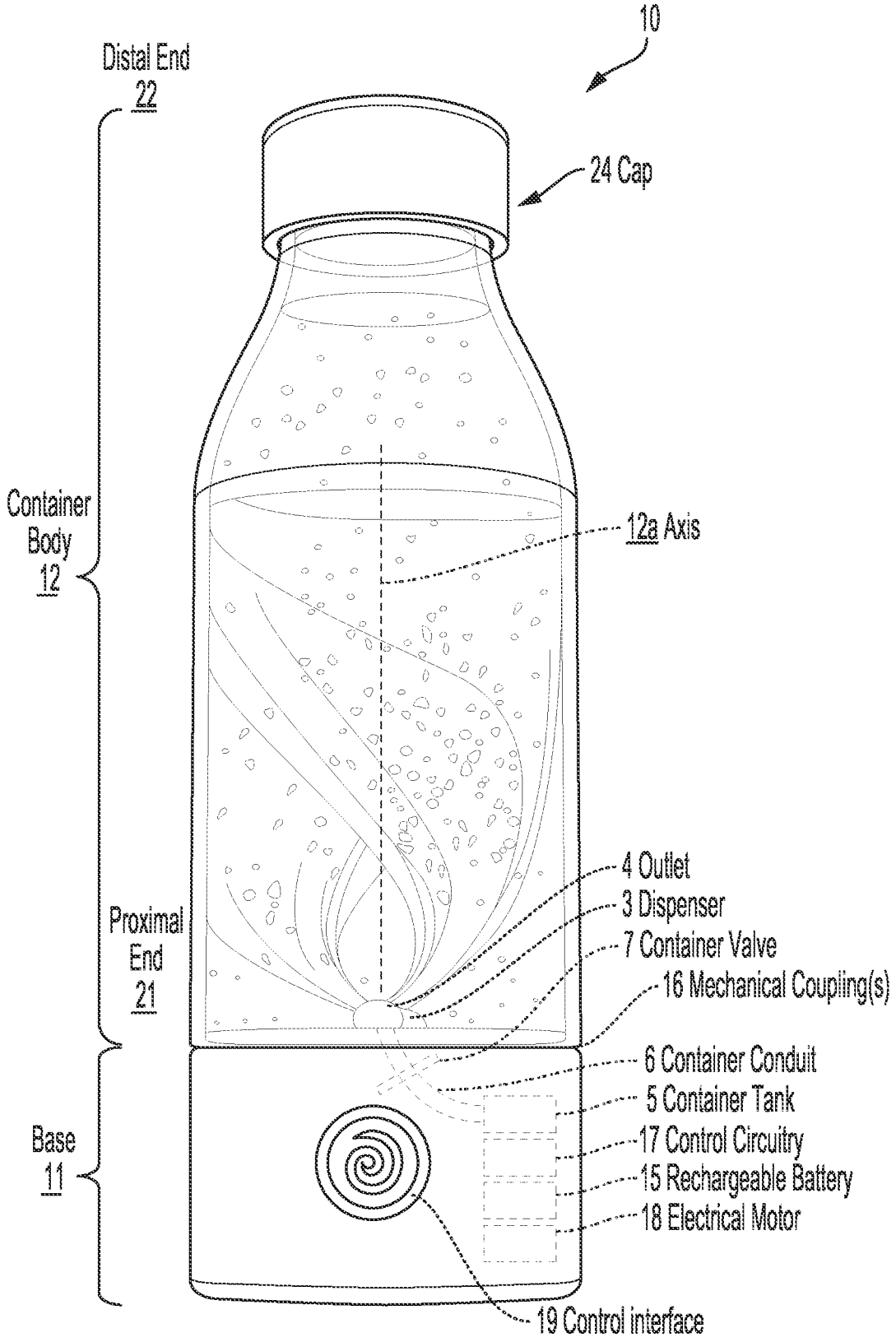
FIG. 1B shows a view of a refillable carbonation container as may be used with a refill station, in accordance with one or more implementations.

As depicted in FIG. 1B, container 10 may include one or more of a base 11, a container tank 5 (depicted in FIG. 1B as a dotted rectangle to indicate this component may be embedded within base 11, and not readily visible from the outside), a container body 12, a (rotatable) dispenser 3, a container conduit 6 (depicted in FIG. 1B as a dotted rectangle to indicate this component may be embedded within base 11, and not readily visible from the outside), a (controllable) container valve 7 (depicted in FIG. 1B as a dotted rectangle to indicate this component may be embedded within base 11, and not readily visible from the outside), a control interface 19, an electrical motor 18 (depicted in FIG. 1B as a dotted rectangle to indicate this component may be embedded within base 11, and not readily visible from the outside), a rechargeable battery 15 (depicted in FIG. 1B as a dotted rectangle to indicate this component may be embedded within base 11, and not readily visible from the outside), control circuitry 17 (depicted in FIG. 1B as a dotted rectangle to indicate this component may be embedded within base 11, and not readily visible from the outside), one or more couplings 16, and/or other components. As depicted in FIG. 1B, during carbonation, rotational movement of dispenser 3 may cause the liquid held in container body 12 to rotate and/or swirl as well.

Referring to FIG. 1A, refill tank 45 of refill station 100 may be configured to hold a pressurized liquid, such as $CO_2$ gas, at a pressure level higher than atmosphere (in some cases, the pressure level may be greater than 101 kPa, or greater than 110 kPa). Refill tank 45 may be a tank, reservoir, container, cartridge, and/or other type of housing. Refill tank 45 may be a pressurized tank. Refill tank 45 may be configured to hold pressurized liquid at a higher pressure level than the pressure level used for container tank 5 of container 10. In other words, the pressure level of container tank 5 may be a first pressure level, the pressure level of refill tank 45 may be a second pressure level, and the first pressure level may be lower than the second pressure level, especially when all or most of the pressurized liquid has been removed from container tank 5. This pressure differential may be used to fill container tank 5 (i.e., the pressure differential may force the transfer of the pressurized liquid). Even when container tank 5 has been filled to (intended) capacity, this maximum container tank pressure level may still be lower than the second pressure level (which, of course, will gradually reduce as more pressurized liquid is transferred from refill tank 45 into container tank 5).

In some implementations, refill tank 45 itself may be refillable. Alternatively, and/or simultaneously, refill tank 45 may be user-replaceable. Refill tank 45 has a particular volume, such that refill tank 45 can hold an amount of pressurized liquid that is sufficient to support at least multiple separate and distinct instances of filling or refilling container tank 5 of container 10. As a result, the user can control refilling at least multiple times the volume of pressurized liquid in container tank 5 using the amount of pressurized liquid held in the volume of refill tank 45. In some implementations, refill tank 45 holds enough pressurized liquid for at least three instances of refilling container tank 5. In some implementations, refill tank 45 holds enough pressurized liquid for at least ten instances of refilling container tank 5. In some implementations, refill tank 45 holds enough pressurized liquid for at least twenty instances of refilling container tank 5. In some implementations, refill tank 45 holds enough pressurized liquid to support between five and ten instances of refilling container tank 5. In some implementations, refill tank 45 holds enough pressurized liquid to support between ten and twenty instances of refilling container tank 5. By way of non-limiting example, in some cases, container tank 5 may hold between 18 and 24 grams of $CO_2$ to support carbonating container 10 three times. By way of non-limiting example, in some cases, container tank 5 may hold between 30 and 40 grams of $CO_2$. By way of non-limiting example, in some cases, refill tank 45 may hold between 50 and 250 grams of $CO_2$. By way of non-limiting example, in some cases, refill tank 45 may hold between 150 and 500 grams of $CO_2$. By way of non-limiting example, in some cases, refill tank 45 may hold about 75 grams, about 100 grams, about 150 grams, about 200 grams, about 250 grams, about 300 grams, about 400 grams, about 500 grams, about 750 grams, about 1000 grams of $CO_2$, and/or another amount of $CO_2$.

In some implementations, refill tank 45 may be included in refill station 100 and/or refill station housing 23 such that container tank 45 forms an integrated whole with refill station housing 23 and/or other components. In such cases, refill tank 45 may be non-user-removable or non-user-replaceable. In some implementations, refill tank 45 may include one or more conduits, connectors, valves, and/or other components configured to couple refill tank 45 to other components of refill station 100 and/or refill station housing 23.

Refill conduit 46 of refill station 100 may be configured to provide a fluid path between refill tank 45 and container tank 5. In some implementations, refill conduit 46 may be configured to couple refill tank 45 to container tank 5. In some implementations, refill station 100 may include multiple conduits. For example, multiple conduits may together provide a fluid path between refill tank 45 and container tank 5. In some implementations, refill conduit 46 may include a (controllable) valve to control transfer of pressurized liquid through refill conduit 46.

Refill valve 47 of refill station 100 may be configured to control transfer of pressurized liquid in refill tank 45 to container tank 5. In some implementations, refill valve 47 may be a controllable valve. In some implementations, refill valve 47 may act as or include a pressure limiter configured to limit the pressure level exposed to container tank 5. In some implementations, operation of refill valve 47 may be based at least in part on user input received through a control interface, e.g., control interface 48. Alternatively, and/or simultaneously, operation of refill valve 47 may be controlled at least in part by control circuitry 49. In some implementations, opening and closing of refill valve 47 may be controlled through mechanical operations, e.g., initiated by a user pressing control interface 48, and, e.g., halted due to pressure changes and/or due to pressure from a spring closing refill valve 47.

Control interface 48 of refill station 100 may be configured to receive user input from a user. Control interface 48 may be part of the user interface of refill station 100. For example, control interface 48 may be configured to be engaged manually by the user. In some implementations, control interface 48 may include a button. For example, the user can press the button to turn refilling operations on and/or off. In some implementations, control interface 48 may include a touchscreen (not depicted). For example, the user can touch the touchscreen to provide the user input. In some implementations, control interface 48 may support multiple types of manual engagement (e.g., including gestures by the user or different kinds of button pushes), including but not limited to a first type of manual engagement, a second type of manual engagement, a third type of manual engagement, and so forth. In some implementations, control interface 48 may be configured to facilitate transitions between different modes of operation of refill station 100. Control interface 48 may convey information regarding the operational status of refill station 100 to a user (e.g., the current mode of operation, whether container 10 has been inserted into refill station 100 properly, the charging status of recharging rechargeable battery 15, etc.). In some implementations, the operational status of refill station 100 may be determined and/or detected by control circuitry 49. Control interface 48 may be controlled by control circuitry 49.

Control circuitry 49 of refill station 100 may be configured to control different functions and/or operations of refill station 100, including but not limited to turning (operations by) refill station 100 on and off, transitioning between different modes of operation of refill station 100, controlling operations of control interface 48, detecting user input received through control interface 48, and/or performing other functions for refill station 100. In some implementations, control circuitry 49 may be configured to convey information regarding the operational status of refill station 100 to a user through control interface 48. For example, control interface 48 may include a light that can illuminate in various colors and/or patterns. In some implementations, control circuitry 49 may be implemented as a printed circuit board (PCB). In some implementations, control circuitry 49 may be integrated into refill station housing 23. In some implementations, control circuitry 49 may be configured to (wirelessly and) electrically charge rechargeable battery 15 that is included in container 10.

Refill station 100 may be configured to operate in at least two different modes of operation, including a ready-for-filling mode of operation and at least one filling mode of operation. Refill station 100 may transition between different modes of operation, e.g., responsive to receiving user input through control interface 48 and/or based on operations and/or control by control circuitry 48. For example, in the ready-for-filling mode of operation, container 10 may have been inserted into refill station housing 23 in such a manner that a connection and/or fluid path from refill tank 45 to container tank 5 is operable, yet not actively transferring pressurized liquid. For example, in at least one filling mode of operation, refill tank 45 may hold and/or otherwise contain $CO_2$, and actively transfer this $CO_2$ into container tank 5 of container 10.

In some implementations, control circuitry 49 may be configured to provide the timing for starting and stopping the transfer of pressurized liquid through refill conduit 46 and/or the opening and closing of refill valve 47. For example, control circuitry 49 may include or control an electrical timer. In some implementations, control circuitry 49 may be configured to provide the timing for starting and stopping the refilling of container tank 5. In some implementations, a single press of the button of control interface 49 may initiate the refilling of container tank 5 for a particular duration. The particular duration may last longer than the single press. The particular duration may be about 5 seconds, about 10 seconds, about 20 seconds, about 30 seconds, about 40 seconds, about 1 minute, about 2 minutes, between 5 and 15 seconds, between 20-40 seconds, between 30-45 seconds, and/or another duration.

Power source or connector 43 of refill station 100 may be configured to power one or more operations of refill station 100, including but not limited to controlling controllable refill valve 47, and/or powering other operations. In some implementations, power source or connector 43 may be a battery. In some implementations, power source or connector 43 (e.g., an electrical plug or a power connector) may be configured to connect refill station 100 to a source of electrical power (e.g., an electrical socket, a power outlet, and/or another source of electrical power).

Referring to FIG. 1B, regarding container 10, base 11 and container body 12 may be configured to be coupled during operation or use of container 10. For example, in some implementations, base 11 and container body 12 may be mechanically coupled, e.g., through one or more (threaded) mechanical couplings 16. Other types of couplings may be envisioned for container 10, though leak-proof options may be preferred, since typical uses include liquids. In some implementations, control circuitry 17 and/or other components may be included in base 11, e.g., completely or partially within base 11. For example, one or more of container tank 5, control circuitry 17, electrical motor 18, rechargeable battery 15, container conduit 6, container valve 7, and/or other components may be integrated permanently into base 11 such that base 11 forms an integral whole.

Figure 4:
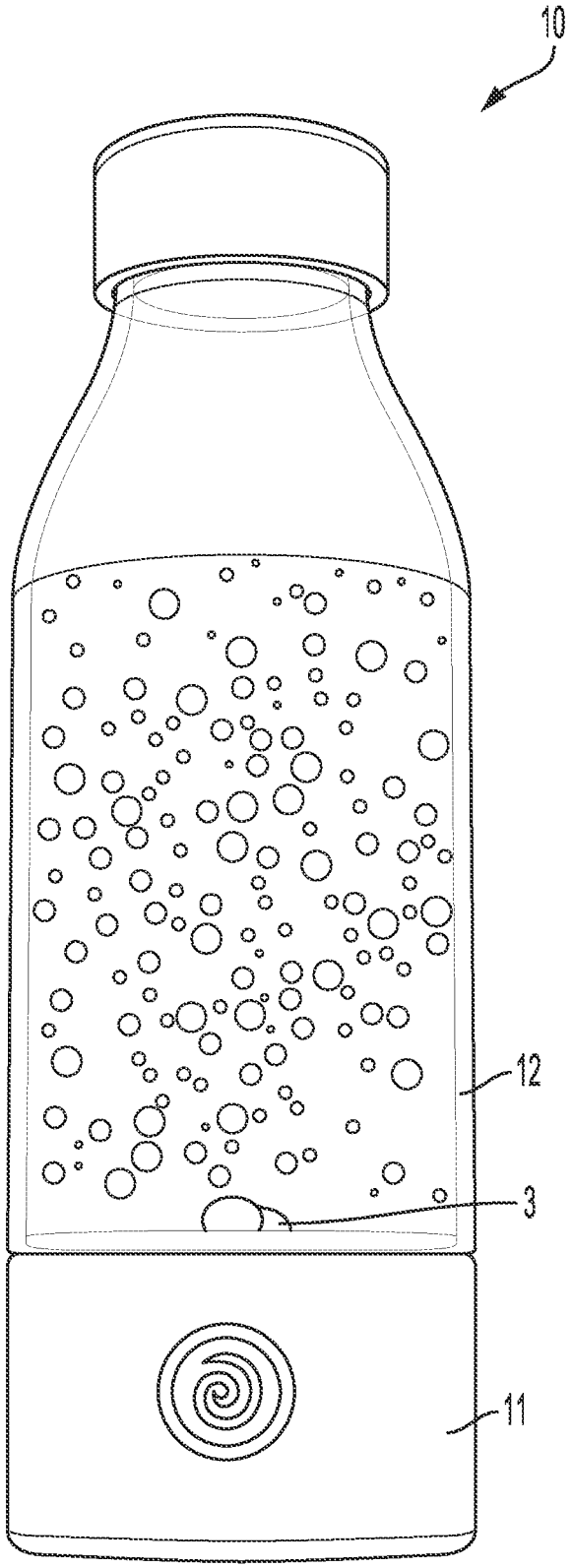
FIG. 4 shows a front view of a refillable carbonation container, which may be refilled by a refill station.

Container 10 may be configured to operate in at least two different modes of operation, including a ready-for-carbonation mode of operation and at least one carbonation mode of operation. Container 10 may transition between different modes of operation, e.g., responsive to receiving user input through control interface 19 and/or based on operations and/or control by control circuitry 17. For example, in the ready-for-carbonation mode of operation, container tank 5 may hold $CO_2$, and dispenser 3 may be inactive, i.e., not dispensing the $CO_2$ from container tank 5 into (the liquid in) container body 12. For example, in at least one carbonation mode of operation, container tank 5 may hold $CO_2$, and dispenser 3 may be active, i.e., dispensing the $CO_2$ from container tank 5 into (the liquid in) container body 12. By way of non-limiting example, FIG. 4 shows a front view of refillable carbonation container 10, after carbonation. For example, container 10 as depicted in FIG. 4 may include a solution of pressurized liquid (e.g., $CO_2$) and potable liquid (e.g., water) that has been created through carbonation (as depicted by the bubbles in FIG. 4).

In some implementations, base 11 of container 10 may include one or more of container tank 5, container conduit 6, container valve 7, control circuitry 17, rechargeable battery 15, electrical motor 18, control interface 19, and/or other components. In some implementations, base 11 may include dispenser 3. In other implementations, container body 12 may include dispenser 3.

Container body 12 of container 10 may be configured to hold a volume of liquid, including but not limited to potable liquid such as water. In some implementations, the volume may range between 12 and 48 ounces. Container body 12 may include a proximal end 21, a distal end 22, a cap 24, and/or other components. Proximal end 21 of container body 12 may be disposed near dispenser 3 during operation of container 10. Distal end 22 of container body 12 may be disposed opposite proximal end 21. In some implementations, proximal end 21 may be at or near at least one of base 11 and container tank 5 during carbonation of the liquid held in container body 12. Container body 12 has a longitudinal axis 12*a* extending through proximal end 21 and distal end 22. In some implementations, container body 12 may have a diameter ranging between 2 and 5 inches.

Container tank 5 of container 10 may be configured to hold a pressurized liquid, such as $CO_2$ gas, at a pressure level higher than atmosphere (in some cases, the pressure level may be greater than 101 kPa, or greater than 110 kPa). Container tank 5 may be a tank, reservoir, container, cartridge, and/or other type of housing. Container tank 5 may be a pressurized tank. Container tank 5 is refillable by refill station 100. Container tank 5 has a particular volume, such that container tank 5 can hold an amount of pressurized liquid that is sufficient to support at least multiple separate and distinct instances of the carbonation of liquid held in container body 12. As a result, the user can control carbonating at least multiple times the volume of liquid in container body 12 using the amount of pressurized liquid held in the volume of container tank 5. In some implementations, container tank 5 holds enough pressurized liquid for at least three instances of the carbonation of liquid held in container body 12. In some implementations, container tank 5 holds enough pressurized liquid for at least ten instances of the carbonation of liquid held in container body 12. In some implementations, container tank 5 holds enough pressurized liquid for at least twenty instances of the carbonation of liquid held in container body 12. In some implementations, container tank 5 holds enough pressurized liquid to support between five and ten instances of the carbonation of liquid held in container body 12. In some implementations, container tank 5 holds enough pressurized liquid to support between ten and twenty instances of the carbonation of liquid held in container body 12. In some implementations, carbonation is performed such that the liquid held in container body 12 includes about 2-3 grams of carbonic acid ($H_2CO_3$) per liter. In some implementations, the particular volume of container tank 5 is between 6 and 8 grams of $CO_2$ per liter of liquid held in container body 12, multiplied by the number of instances of carbonation that are supported. By way of non-limiting example, for a 1-liter container body 12, container tank 5 may hold between 18 and 24 grams of $CO_2$ to support carbonating container 10 three times. By way of non-limiting example, in some cases, for a 1-liter container body 12, container tank 5 may hold between 30 and 40 grams of $CO_2$ to support carbonating container 10 five times, and twice as much to support carbonating container 10 ten times, before needing to be refilled or replaced.

In some implementations, container tank 5 may be included in base 11 such that container tank 5 forms an integrated whole with base 11 and/or other components. In such cases, container tank 5 may be non-user-removable. In some implementations, container tank 5 may include one or more conduits, connectors, valves, and/or other components configured to couple container tank 5 to other components of container 10 (such as, by way of non-limiting example, to dispenser 3).

Regarding container 10, dispenser 3 may be configured to rotate around a rotational axis during the carbonation of liquid held in container body 12. In some implementations, dispenser 3 may rotate around a shaft (not depicted) mounted to the top surface of base 11, e.g., in the center of the top surface of base 11. In some implementations, (rotatable) dispenser 3 is disposed at or near proximal end 21 of container body 12. In some implementations, the rotational axis of dispenser 3 may coincide with longitudinal axis 12*a* of container body 12. Dispenser 3 may include at least one outlet 4. In some implementations, dispenser 3 may include two or more outlets 4.

One or more outlets 4 may be configured such that liquid can exit out of dispenser 3 through one or more outlets 4. In particular, pressurized liquid from container tank 5, upon exiting out of one or more outlets 4, may carbonate (or provide carbonation of) liquid held in container body 12. By virtue of pressurized liquid exiting one or more outlets 4, a solution of pressurized liquid (e.g., $CO_2$) and potable liquid (e.g., water) may be created within container body 12. In some implementations, at least one outlet 4 may be disposed at least a predetermined distance from the rotational axis of dispenser 3 (e.g., longitudinal axis 12*a* of container body 12). In some implementations, this predetermined distance may be about 10 mm. In some implementations, this predetermined distance may be between 5 mm and 15 mm. In some implementations, this predetermined distance may be about half an inch. In some implementations, this predetermined distance may be between 0.25 inches and 1.5 inches. For example, in the case that the predetermined distance is 10 mm, the at least one outlet 4 may move in a circle during rotation of dispenser 3 such that the circle has a diameter of 20 mm. In some implementations, dispenser 3 includes two outlets disposed at opposite ends of dispenser 3.

Container conduit 6 of container 10 may be configured to provide a fluid path between container tank 5 and dispenser 3. In some implementations, container conduit 6 may be configured to couple container tank 5 to dispenser 3. In some implementations, container 10 may include multiple conduits. For example, multiple conduits may together provide a path between container tank 5 and at least one outlet 4. In some implementations, container conduit 6 may include a (controllable) valve to control transfer of pressurized liquid through container conduit 6.

Container valve 7 of container 10 may be configured to control transfer of pressurized liquid in container tank 5 to at least one outlet 4 of dispenser 3. In some implementations, container valve 7 may be a controllable valve. In some implementations, operation of container valve 7 may be based at least in part on user input received through control interface 19. Alternatively, and/or simultaneously, operation of container valve 7 may be controlled at least in part by control circuitry 17. In some implementations, opening and closing of container valve 7 may be controlled through mechanical operations, e.g., initiated by a user pressing control interface 19, and, e.g., halted due to pressure changes within container body 12 and/or due to pressure from a spring closing container valve 7.

In some implementations, container 10 may include electrical motor 18 configured to rotationally drive dispenser 3. In some implementations, electrical motor 18 may operate at a voltage between 5V and 10V. In one or more preferred implementations, electrical motor 18 may operate at a voltage of about 7.4V. Electrical motor 18 may be configured to be powered by rechargeable battery 15. Simultaneously, in some implementations, electrical motor 18 may be further configured to be powered through a standardized charging interface (not depicted). In one or more preferred implementations, no power is (or need be) supplied to container 10 from an external power source during operation of container 10. In some implementations, control circuit 17 may be configured to control electrical motor 18 during operation. For example, control circuit 17 may selectively control the rotation of dispenser 3 during operation of container 10. In some implementations, electrical motor 18 may be integrated into base 11.

In some implementations, container 10 may include rechargeable battery 15 configured to power electrical motor 18 and/or other operations of container 10. In some implementations, rechargeable battery 15 may be configured to power electrical motor 18 such that, during carbonation by container 10, no power is supplied to electrical motor 18 from an external power source. In some implementations, rechargeable battery 15 may be non-removable. As used herein, the term "non-removable" may mean not accessible to users during common usage of container 10, including carbonation, charging, and storing for later use. In some implementations, rechargeable battery 15 may be non-user-replaceable. In some implementations, rechargeable battery 15 may be user-replaceable. In some implementations, rechargeable battery 15 may be store-bought. In some implementations, rechargeable battery 15 may have a capacity between 500 mAh and 4000 mAh. In some implementations, rechargeable battery 15 may have a capacity between 300 mAh and 1000 mAh. In some implementations, control circuit 17 and/or control circuitry 49 may be configured to control charging of rechargeable battery 15. For example, control circuit 17 and/or control circuitry 49 may control the transfer of electrical power through a charging interface into rechargeable battery 15. For example, responsive to a detection that rechargeable battery 15 is fully charged, control circuit 17 and/or control circuitry 49 may prevent the transfer of electrical power into rechargeable battery 15. In some implementations, rechargeable battery 15 may be integrated into base 11.

Control circuitry 17 of container 10 may be configured to control different functions and/or operations of container 10, including but not limited to turning container 10 on and off, transitioning between different modes of operation, charging of rechargeable battery 15, controlling of electrical motor 18 regarding and/or during rotation of dispenser 3, determining whether one or more mechanical couplings 16 are engaged properly for operation, controlling operation of control interface 19, detecting user input received through control interface 19, and/or performing other functions for container 10. In some implementations, control circuitry 17 may be configured to prevent rotation of dispenser 3 (or operation of container valve 7) responsive to a determination that one or more mechanical couplings 16 are not engaged (or not engaged properly for the intended operation of container 10). In some implementations, control circuitry 17 may be configured to convey information regarding the operational status of container 10 to a user by controlling control interface 19. For example, control interface 19 may include a light that can illuminate in various colors and/or patterns. In some implementations, control circuitry 17 may be implemented as a printed circuit board (PCB). In some implementations, control circuitry 17 may be integrated into base 11.

In some implementations, control circuitry 17 may be configured to provide the timing for starting and stopping the dispensing of pressurized liquid through dispenser 3 and/or the opening and closing of container valve 7. For example, control circuitry 17 may include an electrical timer. In some implementations, control circuitry 17 may be configured to provide the timing for starting and stopping the rotation of dispenser 3. In some implementations, a single press of the button of control interface 19 may initiate the carbonation for a particular duration. The particular duration may last longer than the single press. The particular duration may be about 5 seconds, about 10 seconds, about 20 seconds, about 30 seconds, about 40 seconds, about 1 minute, about 2 minutes, between 5 and 15 seconds, between 20-40 seconds, between 30-45 seconds, and/or another duration.

Control interface 19 of container 10 may be configured to receive user input from a user. Control interface 19 may be part of the user interface of container 10. For example, control interface 19 may be configured to be engaged manually by the user. In some implementations, control interface 19 may include a button. For example, the user can press the button to turn carbonation on and/or off. In some implementations, control interface 19 may include a touchscreen (not depicted). For example, the user can touch the touchscreen to provide the user input. In some implementations, control interface 19 may support multiple types of manual engagement (e.g., including gestures by the user or different kinds of button pushes), including but not limited to a first type of manual engagement, a second type of manual engagement, a third type of manual engagement, and so forth. In some implementations, control interface 19 may be configured to facilitate transitions between different modes of operation of refillable carbonation container 10. Control interface 19 may convey information regarding the operational status of container 10 to a user (e.g., the current mode of operation). In some implementations, the operation status of container 10 may be determined and/or detected by control circuitry 17. Control interface 19 may be controlled by control circuitry 17. In some implementations, threaded couplings between base 11 and container body 12 may need to be tightened sufficiently for proper operation, and control interface 19 may warn the user when the treaded couplings are not tightened sufficiently.

Referring to FIG. 1B, in some implementations, base 11 may have a cylindrical shape. For example, horizontal cross-sections of base 11 may have a circular shape. In some implementations, the cylindrical shape of base 11 may have a diameter between 2 and 5 inches, which may be referred to as a base diameter. In some implementations, the cylindrical shape of base 11 may have a base diameter between 3 and 3.5 inches. Such a base diameter may improve portability, as well as allow container 10 to be stored in a cup holder, e.g., in a vehicle.

Figure 3A:
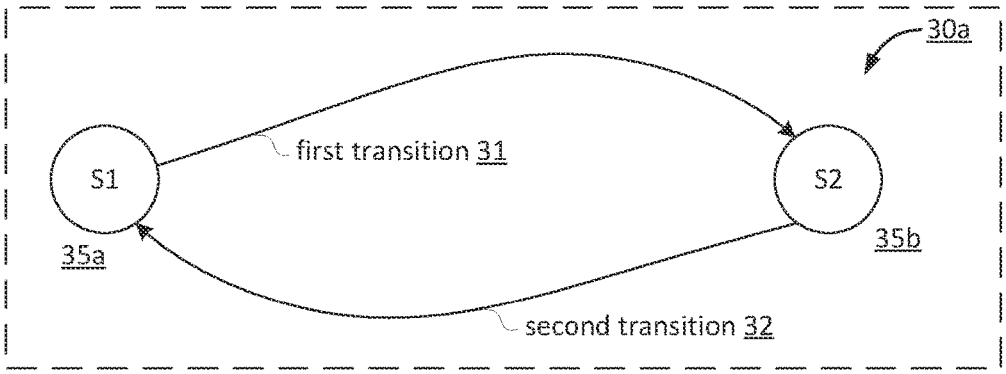
FIGS. 3A-3B-3C-3D illustrate state transitions in state diagrams as may be used by a refill station, in accordance with one or more implementations.

By way of non-limiting example, FIG. 3A illustrates state transitions in a state diagram 30*a* as may be used by refill station 100, e.g., responsive to different types of detections regarding control interface 48 being manipulated by a user as described elsewhere in this disclosure. As depicted, state diagram 30*a* may include a first state 35*a* (labeled "S1") and a second state 35*b* (labeled "S2"). First state 35*a* may correspond to a ready-for-filling mode of refill station 100. Second state 35*b* may correspond to a first filling mode of operation of refill station 100. As depicted here, a first transition 31 may transition the mode of operation of refill station 100 from first state 35*a* to second state 35*b*. A second transition 32 may transition the mode of operation of refill station 100 from second state 35*b* to first state 35*a*. First transition 31 may occur responsive to detection of the first type of detections. Second transition 32 may occur automatically, e.g., after completion of a first refilling operation.

Figure 3B:
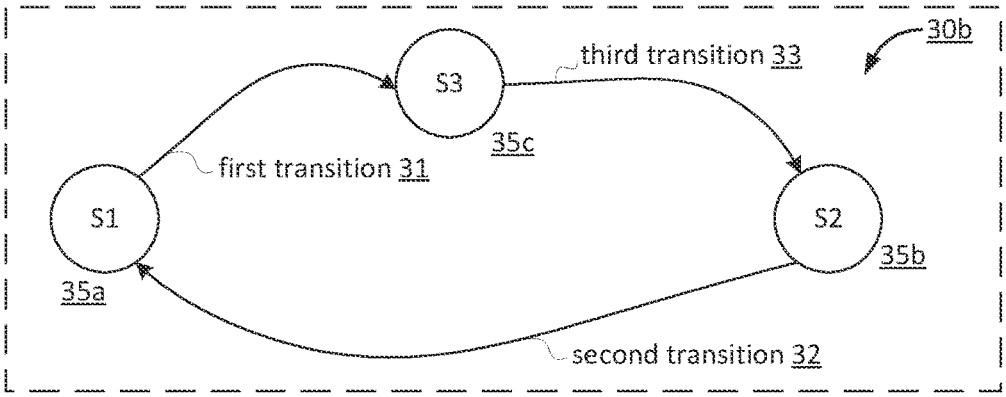

By way of non-limiting example, FIG. 3B illustrates state transitions in a state diagram 30*b* as may be used by refill station 100, e.g., responsive to different types of detections regarding control interface 48 being manipulated by a user as described elsewhere in this disclosure. As depicted, state diagram 30*b* may include a first state 35*a* (labeled "S1"), a second state 35*b* (labeled "S2"), and a third state 35*c*

(labeled "S3"). First state 35*a* may be similar as described regarding FIG. 3A. Second state 35*b* may correspond to a warning mode of operation of refill station 100. Third state 35*c* may correspond to a filling mode of operation of refill station 100. As depicted in state diagram 30*b*, a first transition 31 may transition the mode of operation of refill station 100 from first state 35*a* to third state 35*c*. A second transition 32 may transition the mode of operation of refill station 100 from second state 35*b* to first state 35*a*. A third transition 33 may transition the mode of operation of refill station 100 from third state 35*c* to second state 35*b*. First transition 31 may occur responsive to detection of a particular type of detections. Third transition 33 may occur responsive to detection of an error condition (e.g., a low pressure warning, a no-$0O_2$ warning, an improper connection between container 10 and refill station 100, etc.). In some cases, second transition 32 may occur automatically.

Figure 3C:
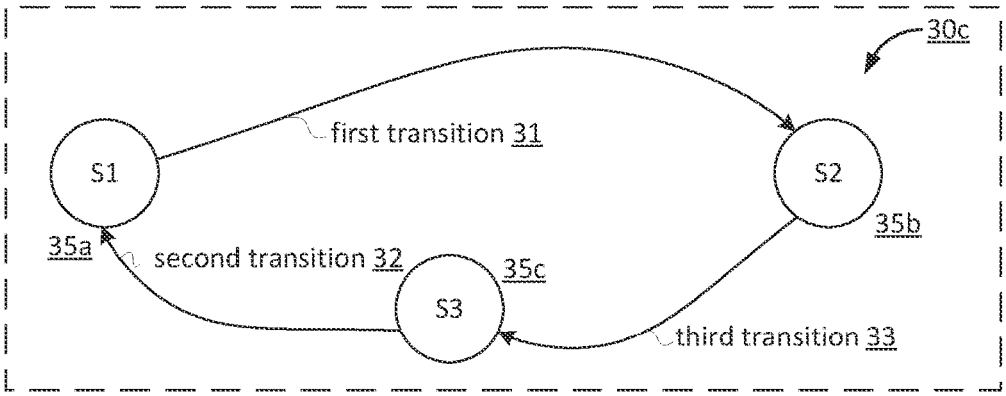

By way of non-limiting example, FIG. 3C illustrates state transitions in a state diagram 30*c* as may be used by refill station 100, e.g., responsive to different types of detections regarding control interface 48 being manipulated by a user as described elsewhere in this disclosure. As depicted, state diagram 30*b* may include a first state 35*a* (labeled "S1"), a second state 35*b* (labeled "S2"), and a third state 35*c* (labeled "S3"). First state 35*a* may correspond to a filling mode of operation. Second state 35*b* may correspond to a different mode of operation of refill station 100 in which the user can interact and/or modify settings of refill station 100. Third state 35*c* may correspond to a warning or error mode of operation of refill station 100 or container 10. As depicted in state diagram 30*b*, a first transition 31 may transition the mode of operation of refill station 100 from first state 35*a* to second state 35*b*. A second transition 32 may transition the mode of operation of refill station 100 from second state 35*b* back to first state 35*a*. A third transition 33 may transition the mode of operation of refill station 100 from first state 35*a* to third state 35*c*. Different transitions may occur responsive to particular types of detections or errors.

Figure 3D:
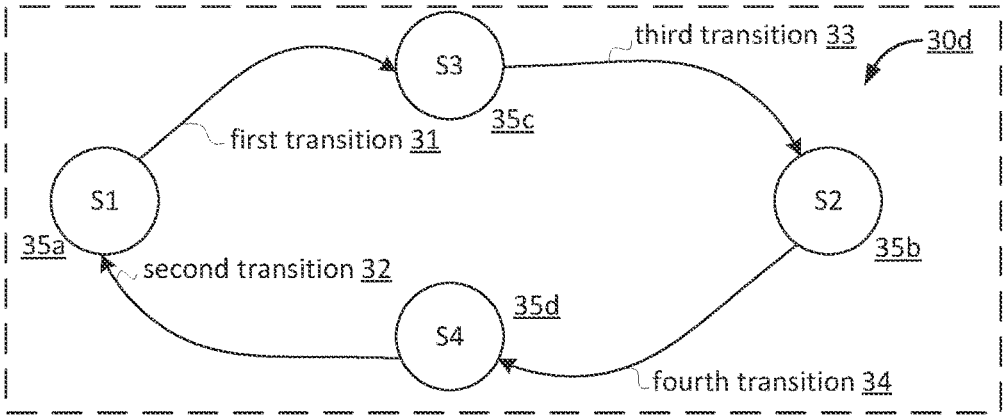

By way of non-limiting example, FIG. 3D illustrates state transitions in a state diagram 30*d* as may be user by refill station 100, e.g., responsive to different types of detections regarding control interface 48 being manipulated by a user as described elsewhere in this disclosure. As depicted, state diagram 30*b* may include a first state 35*a* (labeled "S1"), a second state 35*b* (labeled "S2"), a third state 35*c* (labeled "S3"), and a fourth state 35*d* (labeled "S4"). Multiple depicted states may correspond to different modes of operation. At least one of the depicted states may correspond to a filling mode of operation. Different states may correspond to different presentations or displays being presented on control interface 48. Different transitions may affect both the depicted states and the presented displays.

Referring to FIG. 1B, cap 24 may be disposed at or near distal end 22 of container body 12. Cap 24 may be removable, as depicted in FIG. 4. For example, removing cap 24 may create an opening at distal end 22 of container body 12, e.g., for drinking.

Figure 2:
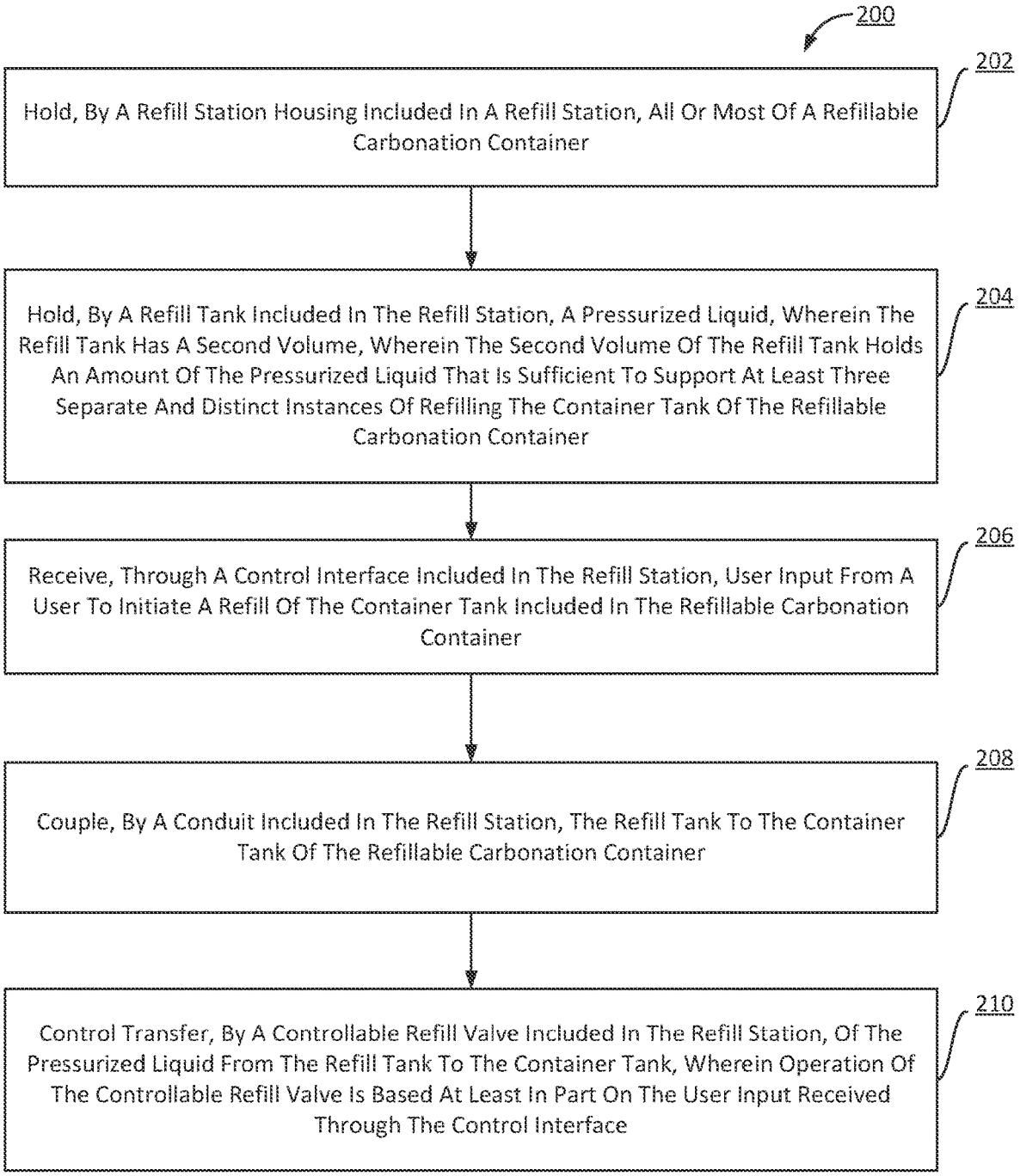
FIG. 2 shows a method of filling or refilling a refillable carbonation container, in accordance with one or more implementations.

FIG. 2 illustrates a method 200 of filling or refilling a refillable carbonation container, in accordance with one or more implementations. The operations of method 200 presented below are intended to be illustrative. In some implementations, method 200 may be accomplished with one or more additional operations not described, and/or without one or more of the operations discussed. Additionally, the order in which the operations of method 200 are illustrated in FIG. 2 and described below is not intended to be limiting.

In some implementations, method 200 may be implemented using one or more processing devices (e.g., a digital processor, an analog processor, a digital circuit designed to process information, an analog circuit designed to process information, a state machine, and/or other mechanisms for electronically processing information). The one or more processing devices may include one or more devices executing some or all of the operations of method 200 in response to instructions stored electronically on an electronic storage medium. The one or more processing devices may include one or more devices configured through hardware, firmware, and/or software to be specifically designed for execution of one or more of the operations of method 200.

At an operation 202, all or part of a refillable carbonation container is held by a refill station housing included in a refill station. In some embodiments, operation 202 is performed by a refill station housing the same as or similar to refill station housing 23 (shown in FIG. 1A and described herein).

At an operation 204, a pressurized liquid is held by a refill tank included in the refill station. The refill tank has a second volume. The second volume of the refill tank holds an amount of the pressurized liquid that is sufficient to support at least three separate and distinct instances of refilling the container tank of the refillable carbonation container, such that the user can control refilling at least three times the container tank by using the amount of the pressurized liquid held in the refill tank. In some embodiments, operation 204 is performed by a refill tank the same as or similar to refill tank 45 (shown in FIG. 1A and described herein).

At an operation 206, if used, user input is received from a user, through a control interface included in the refill station, to initiate a refill of the container tank included in the refillable carbonation container. In some embodiments, operation 206 is performed by a control interface the same as or similar to control interface 48 (shown in FIG. 1A and described herein).

At an operation 208, the refill tank is coupled to the container tank of the refillable carbonation container, by a conduit included in the refill station. In some embodiments, operation 208 is performed by a conduit the same as or similar to refill conduit 46 (shown in FIG. 1A and described herein).

At an operation 210, transfer is controlled, by a controllable refill valve included in the refill station, of the pressurized liquid from the refill tank to the container tank. In some cases, operation of the controllable refill valve may be based at least in part on the user input received through the control interface. In some embodiments, operation 210 is performed by a controllable refill valve the same as or similar to controllable refill valve 47 (shown in FIG. 1A and described herein).

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

What is claimed is:

1. A refill station for a refillable carbonation container, wherein the refill station is configured to refill the refillable carbonation container, and wherein the refillable carbonation container (i) includes a container tank configured to hold a first volume of a pressurized liquid, (ii) is configured to hold a potable liquid within the refillable carbonation container, and (iii) is configured to carbonate the potable liquid held within the refillable carbonation container using the pressurized liquid held within the container tank, wherein the pressurized liquid includes $CO_2$, the refill station comprising:

a refill station housing with an opening wherein the refill station housing is configured to hold all or part of the refillable carbonation container upon insertion of the refillable carbonation container through the opening into the refill station housing, wherein the refill station is configured to removably engage with the refillable carbonation container upon the insertion of the refillable carbonation container through the opening into the refill station housing;

a refill tank configured to hold a second volume of the pressurized liquid, wherein the refill tank is one or both of refillable and/or user-replaceable;

a conduit configured to couple the refill tank to the container tank of the refillable carbonation container upon the insertion of the refillable carbonation container through the opening into the refill station housing; and a controllable refill valve configured to control transferring the pressurized liquid from the refill tank to the container tank;

wherein the refill tank is further configured such that the second volume of the refill tank holds an amount of the pressurized liquid that is sufficient to support at least three separate and distinct instances of refilling the container tank of the refillable carbonation container, such that the container tank can be refilled at least three times by using the amount of the pressurized liquid held in the refill tank.

2. The refill station of claim 1, further comprising a control interface configured to receive user input from a user, wherein operation of the controllable refill valve is based at least in part on the user input received through the control interface.

3. The refill station of claim 2, further including:

control circuitry configured to control the operation of the controllable refill valve, based at least in part on the user input received through the control interface.

4. The refill station of claim 2, wherein the control interface includes a button configured to be pressed by the user, wherein a single press of the button initiates the refilling of the container tank of the refillable carbonation container, from the refill tank of the refill station.

5. The refill station of claim 2, wherein the second volume holds between 50 and 250 grams of $CO_2$.

6. The refill station of claim 5, wherein the second volume supports carbonating a volume of the potable liquid held within the refillable carbonation container between 7 and 40 separate and distinct instances.

7. The refill station of claim 2, wherein the second volume holds between 150 and 500 grams of $CO_2$.

8. The refill station of claim 1, wherein the refill tank forms an integrated whole with the refill station.

9. The refill station of claim 1, wherein both the conduit and the controllable refill valve are integrated with the refill tank.

10. The refill station of claim 1, wherein at least one of the conduit and the controllable refill valve are integrated with the refill tank.

11. The refill station of claim 1, further including:

control circuitry configured to wirelessly and electrically charge a rechargeable battery that is included in the refillable carbonation container.

12. The refill station of claim 1, wherein the refill tank is a user-replaceable cartridge or a user-replaceable gas canister or a user-replaceable gas cylinder.

13. The refill station of claim 1, further comprising the refillable carbonation container.

14. A method of refilling a refillable carbonation container that includes a container tank having a first volume, the method comprising:

holding, by a refill station housing included in a refill station, all or part of the refillable carbonation container upon insertion of the refillable carbonation container through an opening of the refill station housing, wherein the refill station removably engages with the refillable carbonation container upon the insertion;

holding, by a refill tank included in the refill station, a pressurized liquid, wherein the refill tank has a second volume, wherein the second volume of the refill tank holds an amount of the pressurized liquid that is sufficient to support at least three separate and distinct instances of refilling the container tank of the refillable carbonation container, such that the container tank can be refilled at least three times by using the amount of the pressurized liquid held in the refill tank, wherein the pressurized liquid includes $CO_2$;

coupling, by a conduit included in the refill station, the refill tank to the container tank of the refillable carbonation container; and controlling transfer, by a controllable refill valve included in the refill station, of the pressurized liquid from the refill tank to the container tank.

15. The method of claim 14, further comprising:

receiving, through a control interface included in the refill station, user input from a user to initiate a refill of the container tank included in the refillable carbonation container;

wherein operation of the controllable refill valve is based at least in part on the user input received through the control interface.

16. The method of claim 15, wherein the control interface includes a button, and wherein a single press of the button initiates the refilling of the container tank of the refillable carbonation container, from the refill tank of the refill station.

17. The method of claim 14, further comprising:

controlling, by control circuitry, the operation of the controllable refill valve.

18. The method of claim 17, further comprising:

wirelessly and electrically charging, by the control circuitry, a rechargeable battery that is included in the refillable carbonation container.

19. The method of claim 14, wherein the refill station housing includes an opening, and wherein holding all or part of the refillable carbonation container occurs subsequent to inserting all or part of the refillable carbonation container through the opening of the refill station housing.

* * * * *